US006014072A

United States Patent [19]

Gimeno et al.

[11] Patent Number: 6,014,072

[45] Date of Patent: Jan. 11, 2000

[54] CURRENT TRANSFORMER FOR GAS-INSULATED SWITCHGEAR

[75] Inventors: Carmelo Gimeno, Aarau; André Doessegger, Oberentfelden; Christian Tschannen, Uterentfelden, all of Switzerland

[73] Assignee: Alstom AG, Oberentfelden, Switzerland

[21] Appl. No.: 09/247,068

[22] Filed: Feb. 9, 1999

[30] Foreign Application Priority Data

Feb. 9, 1998 [FR] France ..... 98 01470

[51] Int. Cl.[7] ..... H01F 38/20; H01F 17/06

[52] U.S. Cl. ..... 336/173; 336/174; 336/229; 336/175

[58] Field of Search ..... 336/229, 5, 212, 336/173, 174, 175

[56] References Cited

U.S. PATENT DOCUMENTS

| | | | |
|---|---|---|---|
| 1,986,884 | 1/1935 | Fassler . | |
| 2,431,189 | 11/1947 | Moreton et al. | 336/174 |
| 4,338,657 | 7/1982 | Lisin et al. | 363/68 |
| 4,701,738 | 10/1987 | Preissinger et al. | 336/92 |

FOREIGN PATENT DOCUMENTS

| | | | |
|---|---|---|---|
| 0 650 236 A1 | 4/1995 | European Pat. Off. . | |
| 1 030 446 | 5/1958 | Germany . | |
| 94/27306 | 11/1994 | Germany | 336/173 |
| WO 79/00729 | 10/1979 | WIPO . | |

*Primary Examiner*—M. L. Gellner
*Assistant Examiner*—Anh Mai
*Attorney, Agent, or Firm*—Sughrue, Mion, Zinn, Macpeak & Seas, PLLC

[57] ABSTRACT

The present invention relates to a gas-insulated current transformer of simple structure for a single-phase or multi-phase switchgear, which transformer can be made in various dimensions and with magnetic cores of various lengths. The transformer comprises at least one support tube carrying three annular cores carrying respective secondary windings. The windings are superposed and disposed coaxially about the tube, and they are held by a clamping strap. The tube and the windings are disposed inside an enclosure defined by two metal plates constituting a bottom closure end plate and a top closure end plate, and by four metal side walls. The end plates are interconnected by link rods disposed in their corners. The two end plates are fixed to the ends of the rods by screws, and the metal side plates are screwed to said rods. The support tube is gas-tight and its ends are received in appropriate recesses in said end plates, one of the ends being connected to the corresponding closure end plate via an intermediate ring of insulating material.

12 Claims, 5 Drawing Sheets

CURRENT TRANSFORMER FOR GAS-INSULATED SWITCHGEAR

The present invention relates to a gas-insulated current transformer for single-phase or multi-phase switchgear, the transformer comprising at least one support tube on which there is mounted a secondary winding containing a magnetic core, said tube having a primary conductor passing therethrough and being electrically connected at its ends to two polygonal metal plates disposed in parallel and constituting closure end plates for an enclosure that contains, in particular, said magnetic core and said secondary winding.

BACKGROUND OF THE INVENTION

Devices of that type are already known, and they present various drawbacks to which the present invention seeks to provide a solution that is advantageous from technical and economic points of view.

German utility certificate DE-GM 7914263 describes a single-pole current transformer of that type. The core support tube is put into place in appropriate recesses formed in two end plates. An insulating ring is associated with one plate to avoid making an electrical connection between the two plates via the support tube. A peripheral cylindrical tube surrounding the core is placed between the two plates which are also coupled together by means of clamping screws. By adjusting the length of the support tube and of the peripheral cylindrical tube it is possible in simple manner to make different transformers provided with various numbers of cores of different lengths.

Nevertheless, the outside diameter of the transformer is necessarily greater than that of the largest core so as to leave a gap for passing the clamping screws. Given that the diameter of the transformer is crucial in determining the space occupied by multi-pole switchgear, since it defines the spacing between the transformers corresponding to respective phases, the solution recommended is not advantageous because it does not enable the dimensions of the switchgear to be reduced.

European patent application published under the number EP 0 665 561 A1 describes a single-pole current transformer having an annular core in which the metal enclosure is made up of two castings. One of the castings constitutes a base plate and the other casting constitutes the side walls of the metal enclosure and also its top closure plate. Each of the two parts has a peripheral belt, these belts being organized to be juxtaposed and partially engaged and clamped one against the other by bolts. The belts are of diameter greater than the diameter of the core.

To modify the length of the current transformer, it is necessary to modify the length of the two castings accordingly. This means that for each type of current transformer, it is essential to make two molds corresponding respectively to the two castings of different lengths.

OBJECTS AND SUMMARY OF THE INVENTION

An object of the present invention is to provide a current transformer of the above type that is simple in structure, that can be made in various different sizes, and in particular with magnetic cores of different lengths, while using components that are easy to manufacture.

This object is achieved by the transformer of the invention, wherein the support tube is gas-tight and is received at each of its ends in sealed manner in appropriate recesses formed in said closure end plates of the enclosure, one of the ends being connected to the corresponding closure end plate via an intermediate ring of insulating material, and said closure end plates being interconnected by rigid link rods which are located in the corners of the end plates.

Advantageously, for multi-phase switchgear, the closure end plates are common to a plurality of magnetic cores respectively corresponding to a plurality of phases and each having a plurality of recesses each organized to receive and house in sealed manner an end of a support tube for magnetic cores corresponding to one of the phases.

Preferably, said recesses are disposed in line.

In a preferred embodiment, the link rods are electrically connected via their ends to the closure plates. This linking is performed by the rods being screwed into said closure plates.

The transformer may also include two link rods disposed between two adjacent secondary windings corresponding to two of the phases of the switchgear.

In a preferred embodiment, said closure end plates are identical.

Advantageously, the secondary winding is secured to one of said plates by means of at least one clamping strap and said plate has at least one lug and an opening formed in said lug for passing said clamping strap.

Preferably, said link rods are of quadrangular cross-section and said enclosure has side walls fixed to said link rods.

Advantageously, said side walls are fixed to the link rods by means of screws, and the screws are disposed in asymmetrical manner about the longitudinal axis of the transformer.

Advantageously, the transformer includes a connection box containing connection terminals that are electrically connected to said secondary windings.

BRIEF DESCRIPTION OF THE DRAWINGS

The present invention will be better understood from the following description of an embodiment and from the accompanying drawings, in which.

MORE DETAILED DESCRIPTION

Figure 1:
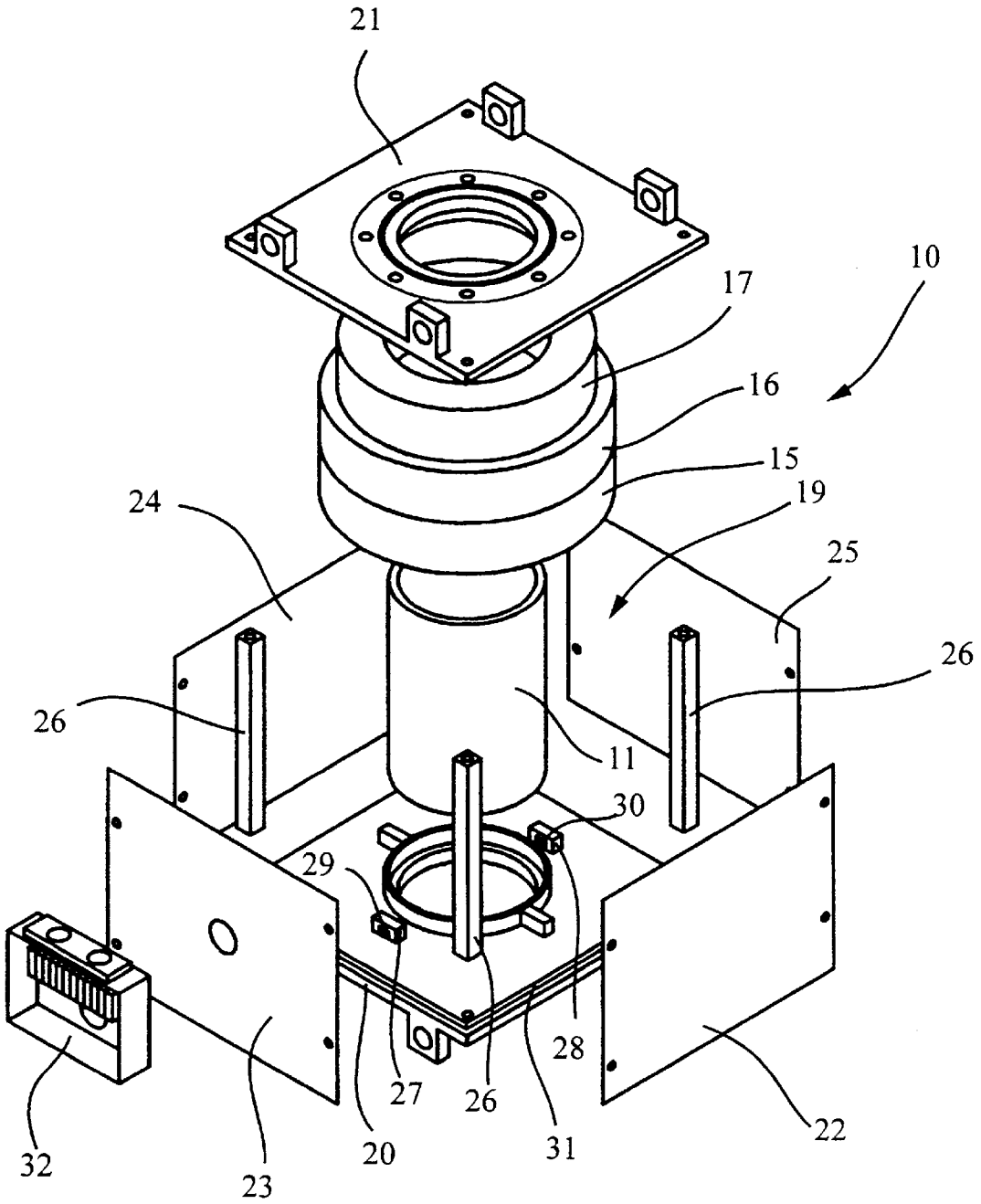
FIG. 1 is an exploded perspective view of a single phase current transformer of the invention.
Figure 2:
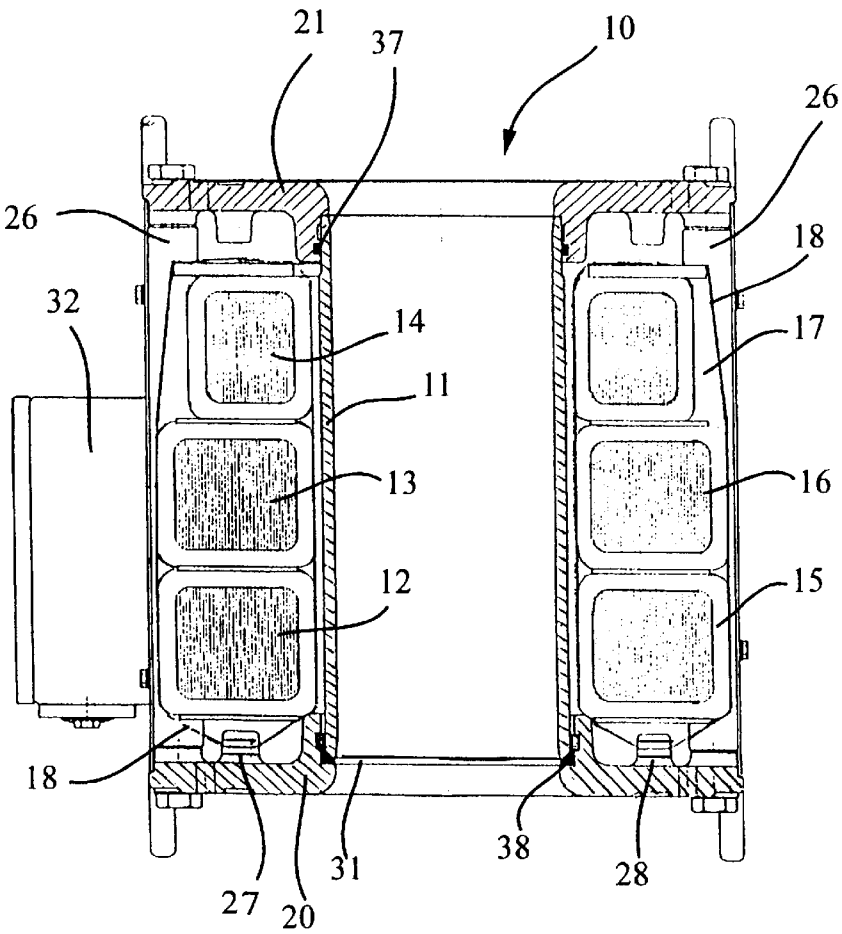
FIG. 2 is an axial section view of the FIG. 1 current transformer.
Figure 4:
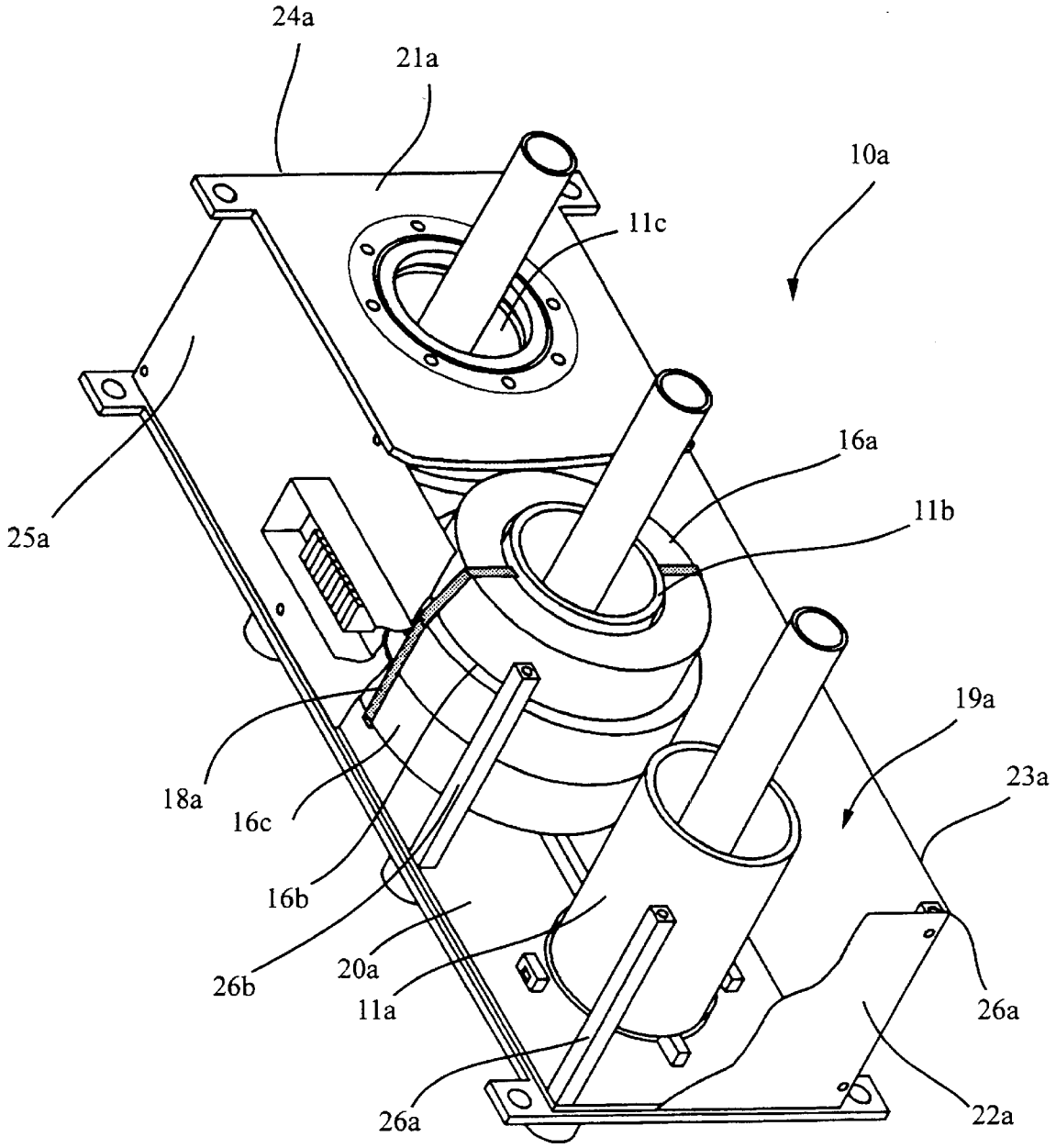
FIG. 4 is a perspective view, partially in section, of a multi-phase current transformer of the invention.
Figure 5:
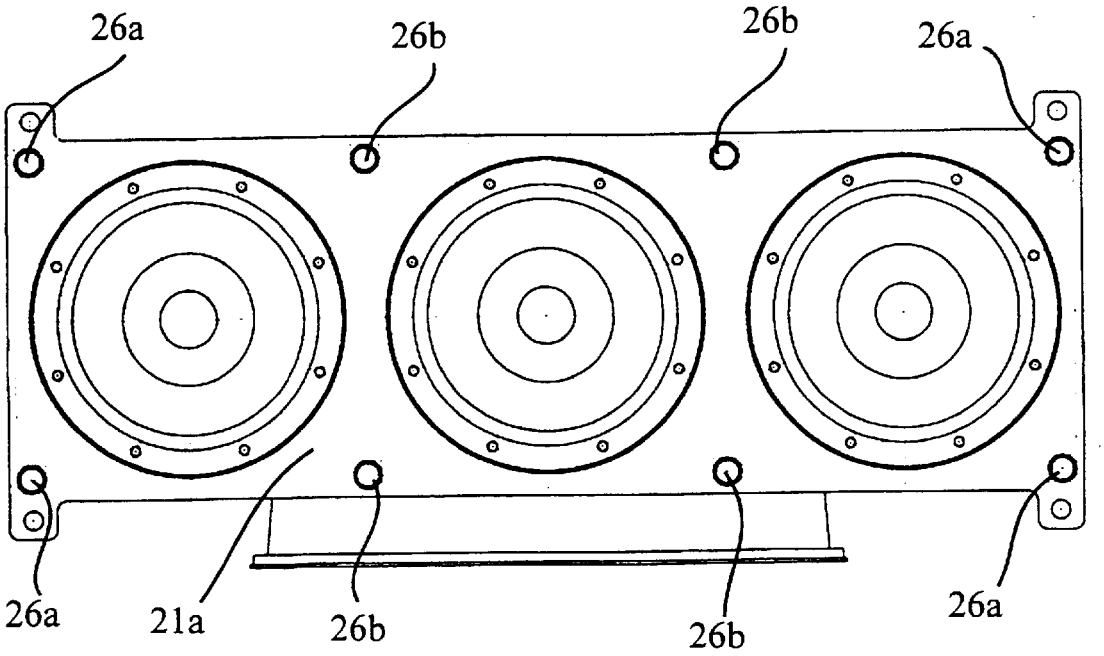
FIG. 5 is a plan view of the FIG. 4 current transformer.
Figure 7:
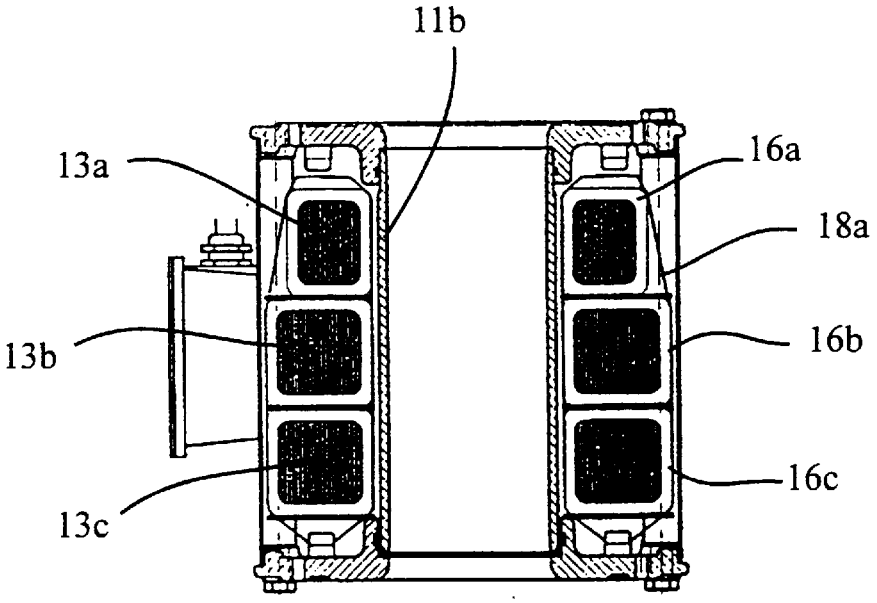
FIG. 7 is a cross-section view of the FIG. 5 current transformer.
Figure 6:
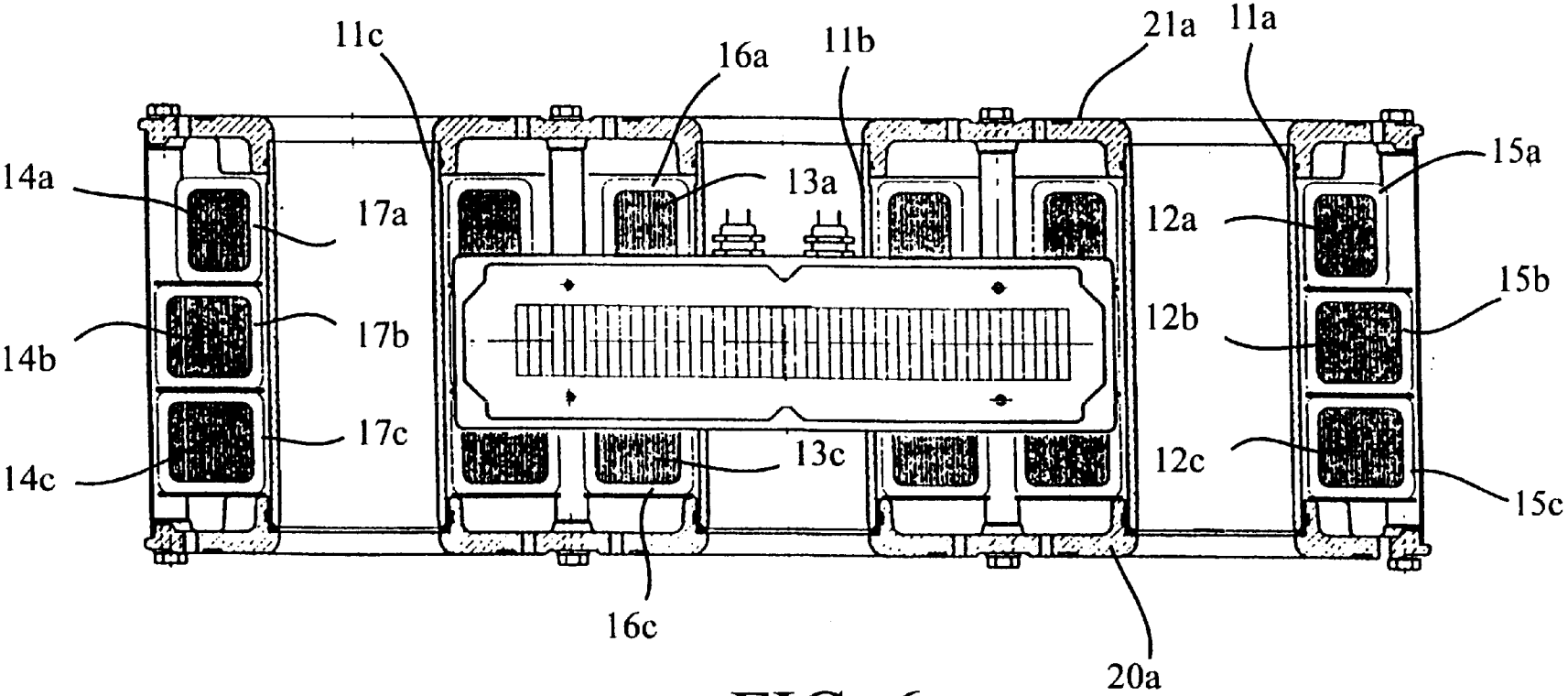
FIG. 6 is an axial section view of the FIG. 5 current transformer.

With reference to FIGS. 1 and 2, the single-phase current transformer 10 as shown comprises a support tube 11 carrying at least one, and in the present case three, annular cores 12, 13, and 14 carrying respective secondary windings 15, 16, and 17. These secondary windings are superposed and are disposed coaxially about the support tube 11. They are clamped against one another by means of a clamping strap 18. The support tube 11 and the secondary windings 15, 16, 17 are disposed inside an enclosure 19 defined by two metal plates respectively constituting a bottom closure end plate 20 and a top closure end plate 21, and by four side walls constituted by metal plates 22, 23, 24, and 25.

The closure end plates 20 and 21 are interconnected by link rods 26 located in the corners of the closure end plates 20 and 21, which end plates are preferably polygonal in shape and are square in the present example. Both closure end plates 20 and 21 are fixed to the corresponding ends of the link rods 26 by screws, and the metal side plates 22, 23, 24, and 25 are also screwed to the link rods 26.

The bottom closure end plate 20 has two diametrically opposite lugs 27 and 28 each having a respective through openings 29 or 30 for passing two diametrically opposite clamping straps 18, provided to hold the secondary windings in position around the support tube 11.

As shown more particularly in the section view of FIG. 2, the ends of the support tube 11 are received in recesses formed in the two closure end plates 20 and 21. To this end, these two recesses are given profiles that are appropriate for receiving the ends of the support tube. Sealing rings 37 provide sealing between the support tube 11 and the closure end plates 20 and 21. The support tube is electrically insulated from the bottom closure end plate 20 by means of an insulating ring 38 and it is electrically connected to the top closure end plate 21.

A connection box 32 containing connection terminals is mounted on the side of the transformer 10, and more particularly on the metal plate 23 constituting one of the side walls of the enclosure 19.

Figure 3:
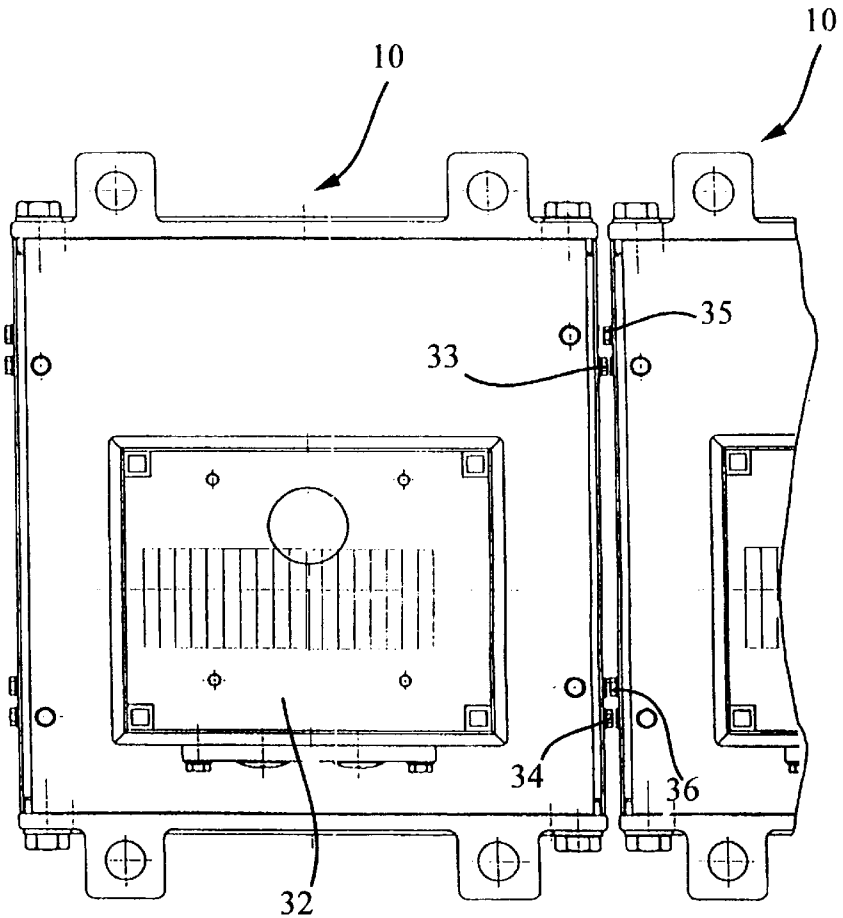
FIG. 3 is an elevation view showing a portion of switchgear having at least two current transformers as shown in FIG. 1 and 2.

FIG. 3 serves mainly to show how two current transformers 10 as described above are juxtaposed. The metal plates constituting the facing side walls of the two current transformers that are placed side by side are fixed by means of screws 33, 34 on one transformer and 35, 36 on the other. In order to avoid extra thickness due to the screws, they are disposed in asymmetrical manner. Two screws of one plate, one located close to its top corner and the other close to its opposite bottom corner, are used for fixing the plate to two corresponding link rods 26. This serves to reduce the overall size of the transformer.

Furthermore, it will be observed that the bottom and top closure end plates have the same profile, thereby making it possible to reduce manufacturing costs and avoiding the need to store two different parts.

With reference to FIGS. 4 to 7, a multi-phase current transformer 10*a*, and more particularly the three-phase transformer as shown, has three support tubes 11*a*, 11*b*, and 11*c* each carrying at least one annular core, and in the present case each carrying three annular cores 12*a*, 12*b*, 12*c*; 13*a*, 13*b*, 13*c*; 14*a*, 14*b*, 14*c* each carrying a respective secondary winding 15*a*, 15*b*, 15*c*; 16*a*, 16*b*, 16*c*; 17*a*, 17*b*, 17*c*. These windings are superposed and disposed coaxially on the tubes as in the above-described transformer 10. They are also clamped together and held in place by clamping straps 18*a*. The support tubes 11*a*, 11*b*, and 11*c* and the corresponding windings are disposed inside an enclosure 19*a* defined by two metal plates respectively constituting a bottom closure end plate 20*a* and a top closure end plate 21*a*, and by four side walls constituted by metal plates 22*a*, 23*a*, 24*a*, and 25*a*.

It will be observed that the enclosure 19*a* is common for all three support tubes and the corresponding secondary windings. As before, the closure end plates 20*a* and 21*a* have recesses of appropriate profile for receiving the ends of the support tubes. These tubes are electrically insulated from the bottom closure end plate 20*a* by means of respective rings of electrically insulating material and they are electrically connected to the top closure end plate 21*a*.

The closure end plates 20*a* and 21*a* are interconnected by link rods 26*a* located in the corners of the rectangular-shaped closure end plates and by intermediate link rods 26*b* disposed in pairs between adjacent support tubes and the corresponding secondary windings.

As before, the metal plates 22*a*, 23*a*, 24*a*, and 25*a* constituting the side walls are rectangular in shape and they are screwed directly to the link rods 26*a* and 26*b*.

The current transformer of the invention enables the components corresponding to the various phases to be brought together in such a manner as to reduce overall size. The size of the enclosure is hardly any greater than that of the corresponding secondary winding(s). When using the single-phase embodiment, bringing a plurality of phases together gives rise to an overall size that is slightly greater than that occupied when a plurality of phases are brought together in the same enclosure as in the multi-phase embodiment.

The structure of the current transformer is also advantageous because changing the dimensions of the support tube, of the magnetic core, or of the secondary windings does not give rise to significant excess cost.

Construction is easy and gives rise to a device which is robust.

The present invention is not limited to the embodiment described, but extends to any variant or modification that is obvious for the person skilled in the art.

What is claimed is:

1. A gas-insulated current transformer for single-phase or multi-phase switchgear, the transformer comprising at least one support tube on which there is mounted a secondary winding containing a magnetic core, said tube having a primary conductor passing therethrough and being electrically connected at its ends to two polygonal metal plates disposed in parallel and constituting closure end plates for an enclosure that contains, in particular, said magnetic core and said secondary winding, wherein the support tube is gas-tight and is received at each of its ends in sealed manner in appropriate recesses formed in said closure end plates of the enclosure, one of the ends being connected to the corresponding closure end plate via an intermediate ring of insulating material, said closure end plates being interconnected by rigid link rods which are located in the corners of the end plates and which are electrically connected via their ends to said closure end plates.

2. A transformer according to claim 1, wherein for multi-phase switchgear, the closure end plates are common to a plurality of magnetic cores respectively corresponding to a plurality of phases and each having a plurality of recesses each organized to receive and house in sealed manner an end of a support tube for magnetic cores corresponding to one of the phases.

3. A transformer according to claim 2, wherein said recesses are disposed in line.

4. A transformer according to claim 1, wherein the link rods are connected to said closure end plates by screws.

5. A transformer according to claim 2, further including two link rods disposed between two adjacent secondary windings corresponding to two of the phases of the switchgear.

6. A transformer according to claim 1, wherein said closure end plates are identical.

7. A transformer according to claim 1, wherein the secondary winding is secured to one of said closure end plates by means of at least one clamping strap.

8. A transformer according to claim 7, wherein said closure end plate has at least one lug and an opening formed in said lug for passing said clamping strap.

9. A transformer according to claim 1, wherein said link rods are of quadrangular cross-section.

10. A transformer according to claim 1, wherein said enclosure has side walls fixed to said link rods.

11. A transformer according to claim 10, wherein said side walls are fixed to the link rods by means of screws, and wherein the screws are disposed in asymmetrical manner about the longitudinal axis of the transformer.

12. A transformer according to claim 1, including a connection box containing connection terminals that are electrically connected to said secondary windings.

* * * * *